US010875731B1

(12) United States Patent
Kamano

(10) Patent No.: US 10,875,731 B1
(45) Date of Patent: Dec. 29, 2020

(54) IMAGE FORMING APPARATUS

(71) Applicant: TOSHIBA TEC KABUSHIKI KAISHA, Tokyo (JP)

(72) Inventor: Tadao Kamano, Izu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/575,150

(22) Filed: Sep. 18, 2019

(51) Int. Cl.

| | |
|---|---|
| ***G03G 21/20*** | (2006.01) |
| ***B65H 11/00*** | (2006.01) |
| ***B65H 29/24*** | (2006.01) |
| ***B65H 5/06*** | (2006.01) |

(52) U.S. Cl.
CPC ..... *B65H 11/007* (2013.01); *B65H 5/06* (2013.01); *B65H 29/245* (2013.01); *B65H 2402/45* (2013.01)

(58) Field of Classification Search
CPC .... B65H 11/007; B65H 29/245; B65H 29/45; G03G 21/206; G03G 2221/1645; G03G 2215/00928; G03G 15/2017
USPC ..... 399/92, 107, 361, 388, 364; 358/474, 358/488
See application file for complete search history.

(56) References Cited

U.S. PATENT DOCUMENTS

2012/0213564 A1* 8/2012 Tashiro ..... G03G 15/235 399/335
2016/0091860 A1* 3/2016 Kawai ..... G03G 21/206 399/44

FOREIGN PATENT DOCUMENTS

EP 2 490 080 A1 8/2012
JP 2012-173305 A2 9/2012

* cited by examiner

*Primary Examiner* — Thomas A Morrison
(74) *Attorney, Agent, or Firm* — Foley & Lardner LLP

(57) ABSTRACT

An image forming apparatus comprises a main body, a conveyance path, a first external cover and a second external cover. The first cover provided in the main body to cover the conveyance path includes a blocking wall facing the conveyance path; a concave portion provided below the blocking wall and recessed toward the main body with respect to a lower end of the blocking wall; a communication portion, provided between the lower end of the blocking wall and an upper end of the concave portion, that penetrates the first external cover and faces an outer space of the image forming apparatus at a position that extends from the concave portion to the blocking wall; and an air exhaust portion provided above the blocking wall.

10 Claims, 7 Drawing Sheets

IMAGE FORMING APPARATUS

FIELD

Embodiments described herein relate generally to an image forming apparatus.

BACKGROUND

At the time of printing, an image forming apparatus such as an multi-function peripheral discharges a sheet to a sheet discharge tray of a sheet discharge section through a transfer section and a fixing section from a sheet feed section. In recent years, the image forming apparatus generally has a duplex printing mechanism. In a case in which the printing is performed on both surfaces of the sheet, the image forming apparatus first performs printing on a first surface of the sheet conveyed from the sheet feed section through the transfer section and the fixing section, and then conveys the sheet to the sheet discharge section. Next, the sheet discharge section of the image forming apparatus switches back the sheet of which the first surface is printed before the sheet of which the first surface is printed is discharged to the sheet discharge tray. The image forming apparatus performs printing on a second surface opposite to the first surface of the sheet switched back and passing through the transfer section and the fixing section again via a conveyance path of the duplex printing mechanism, and then discharges the sheet to the sheet discharge tray of the sheet discharge section.

DETAILED DESCRIPTION

In accordance with an embodiment, an image forming apparatus comprises a main body; a conveyance path provided in the main body and configured to extend in a vertical direction; a first external cover provided in the main body and configured to cover the conveyance path; and a second external cover provided at the outside of the first external cover and configured to secure a space. The first external cover includes a blocking wall facing the conveyance path; a concave portion provided below the blocking wall and recessed toward the main body with respect to a lower end of the blocking wall; a communication portion, provided between the lower end of the blocking wall and an upper end of the concave portion, that penetrates the first external cover and is positioned below the blocking wall so as to face an outer space of the image forming apparatus at a position that extends from the concave portion to the blocking wall; and an air exhaust portion, provided above the blocking wall, that penetrates the first external cover.

First Embodiment

An image forming apparatus 10 according to the first embodiment is described with reference to FIGS. 1 to 6B.

Figure 1:
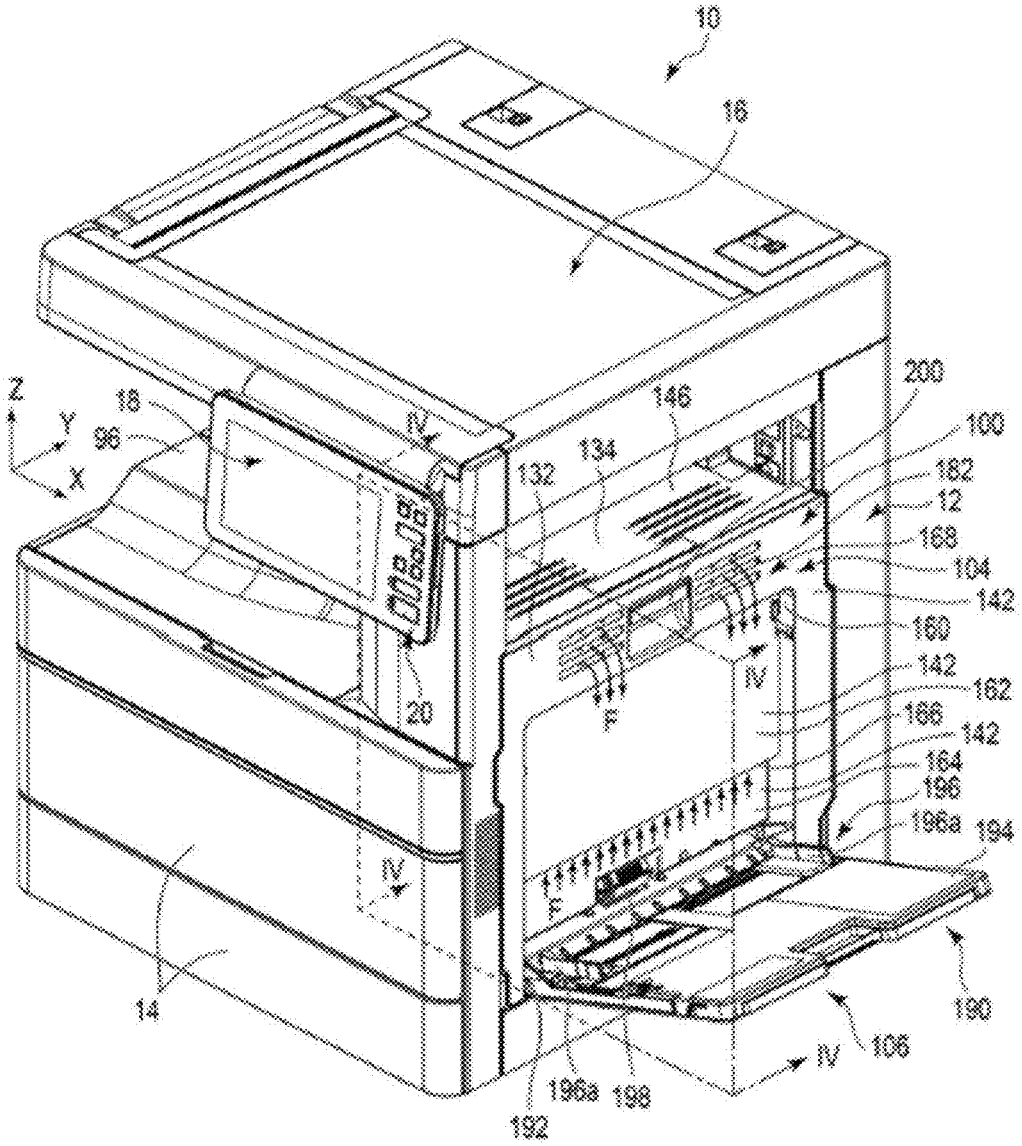
FIG. 1 is a perspective view schematically illustrating an image forming apparatus as viewed obliquely from above according to a first embodiment.
Figure 2:
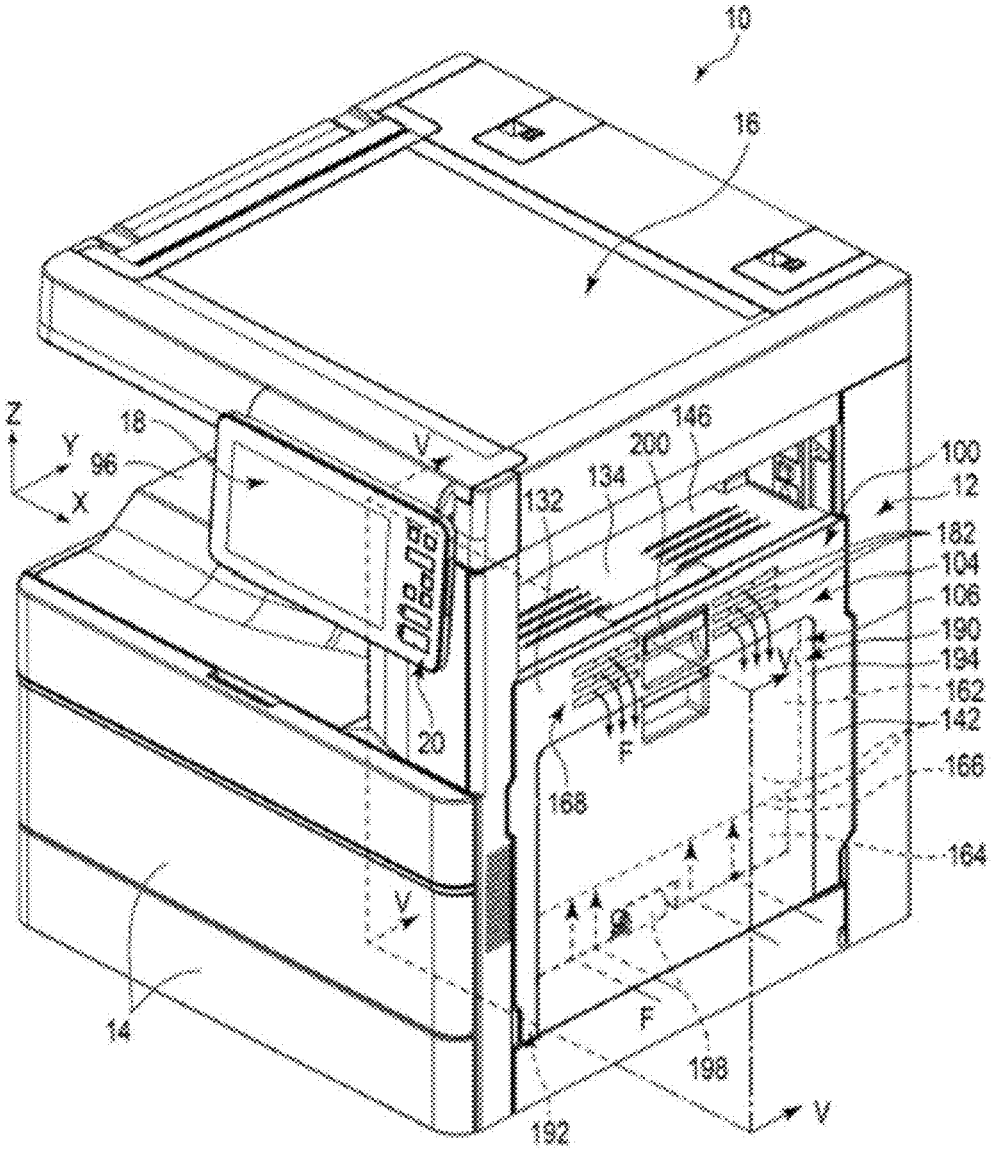
FIG. 2 is a perspective view schematically illustrating the image forming apparatus as viewed obliquely from above according to the first embodiment.
Figure 3:
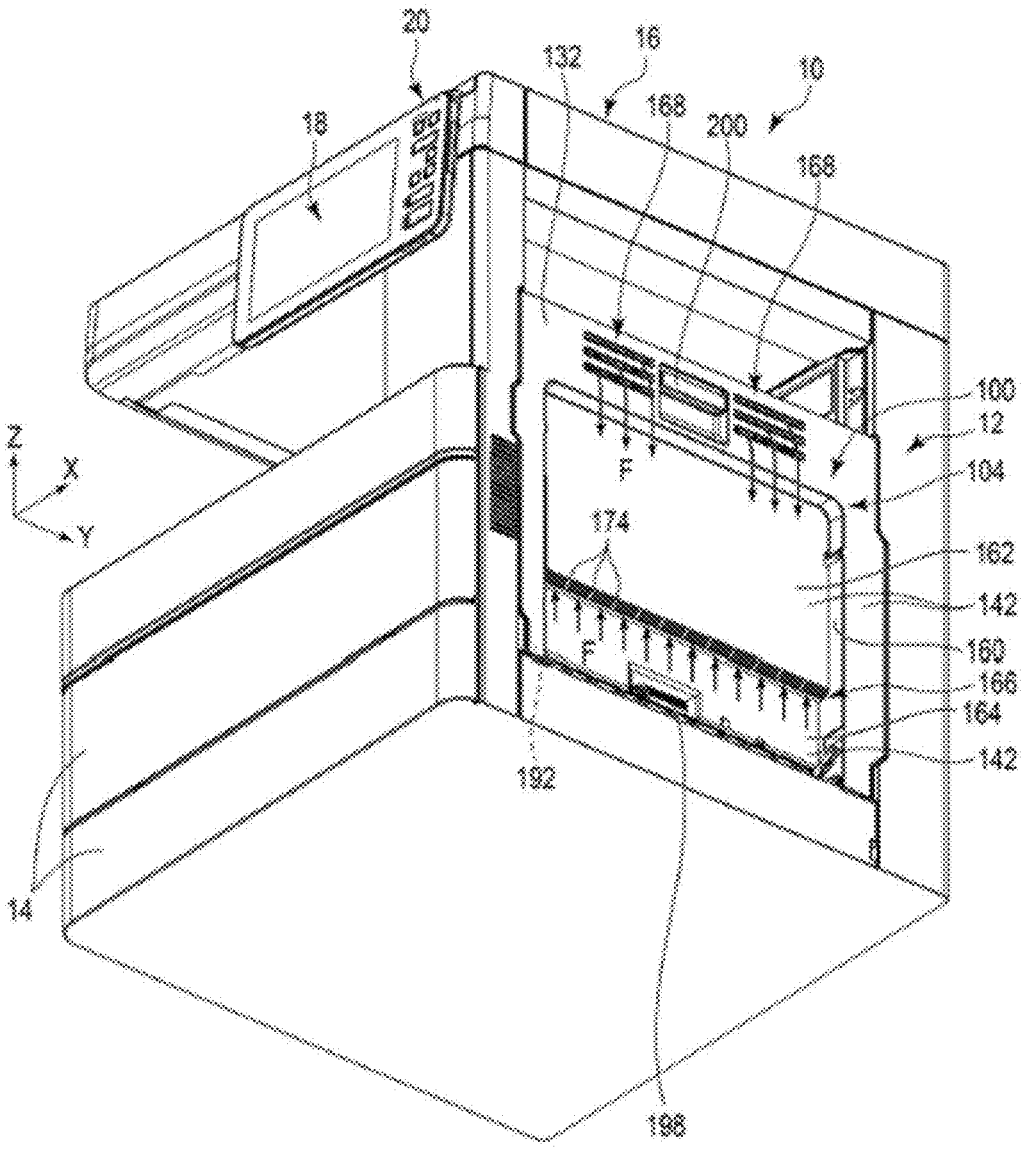
FIG. 3 is a perspective view schematically illustrating the image forming apparatus as viewed obliquely from below according to the first embodiment.

FIGS. 1 to 3 show the image forming apparatus 10 according to the first embodiment. In FIGS. 1 and 2, a front side, a right side and an upper surface of the image forming apparatus 10 are shown. In FIG. 3, a front side, a right side and a lower surface of the image forming apparatus 10 are shown. In an example shown in FIG. 3, a state in which a second external cover 106 (sheet feed tray 190) described below of the image forming apparatus 10 is removed is shown.

The image forming apparatus 10 can be a multi-function peripheral having an image reading function, a printing function, or the like. The image forming apparatus 10 may be exclusively used for a printer having the printing function.

As shown in FIGS. 1 to 3, an external appearance of the image forming apparatus 10 has a substantially rectangular parallelepiped shape. An XYZ orthogonal coordinate system is adopted as shown in FIGS. 1 to 3 to describe the image forming apparatus 10. An X-axis direction indicates a horizontal direction of the image forming apparatus 10. A Y-axis direction indicates a front-rear direction of the image forming apparatus 10. A Z-axis direction indicates a vertical direction of the image forming apparatus 10.

The image forming apparatus 10 includes a main body 12, a sheet housing section 14, a scanner section 16, a display section 18 and a control panel 20.

Figure 4:
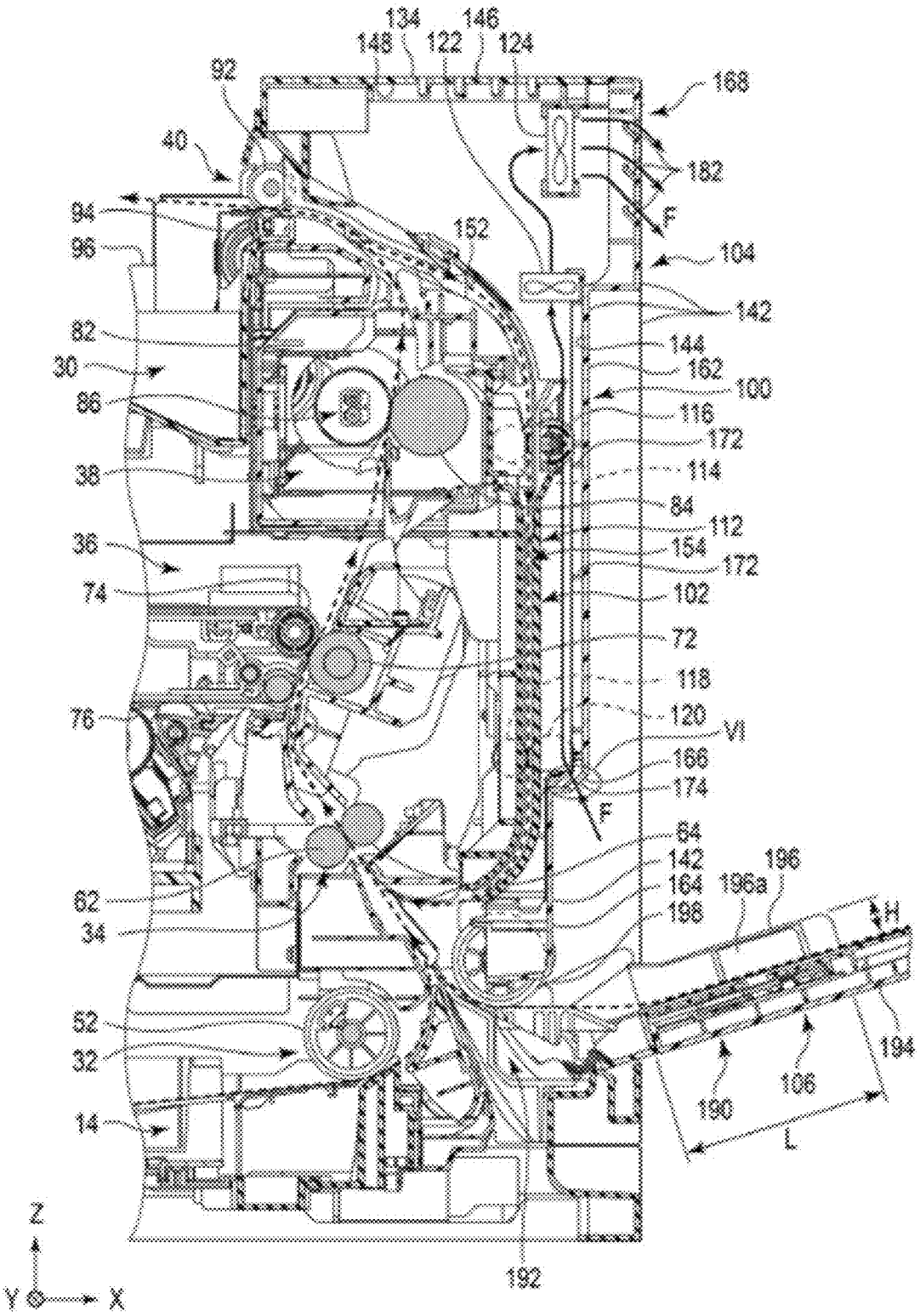
FIG. 4 is a schematic cross-sectional view taken along a surface IV-IV in FIG. 1.
Figure 5:
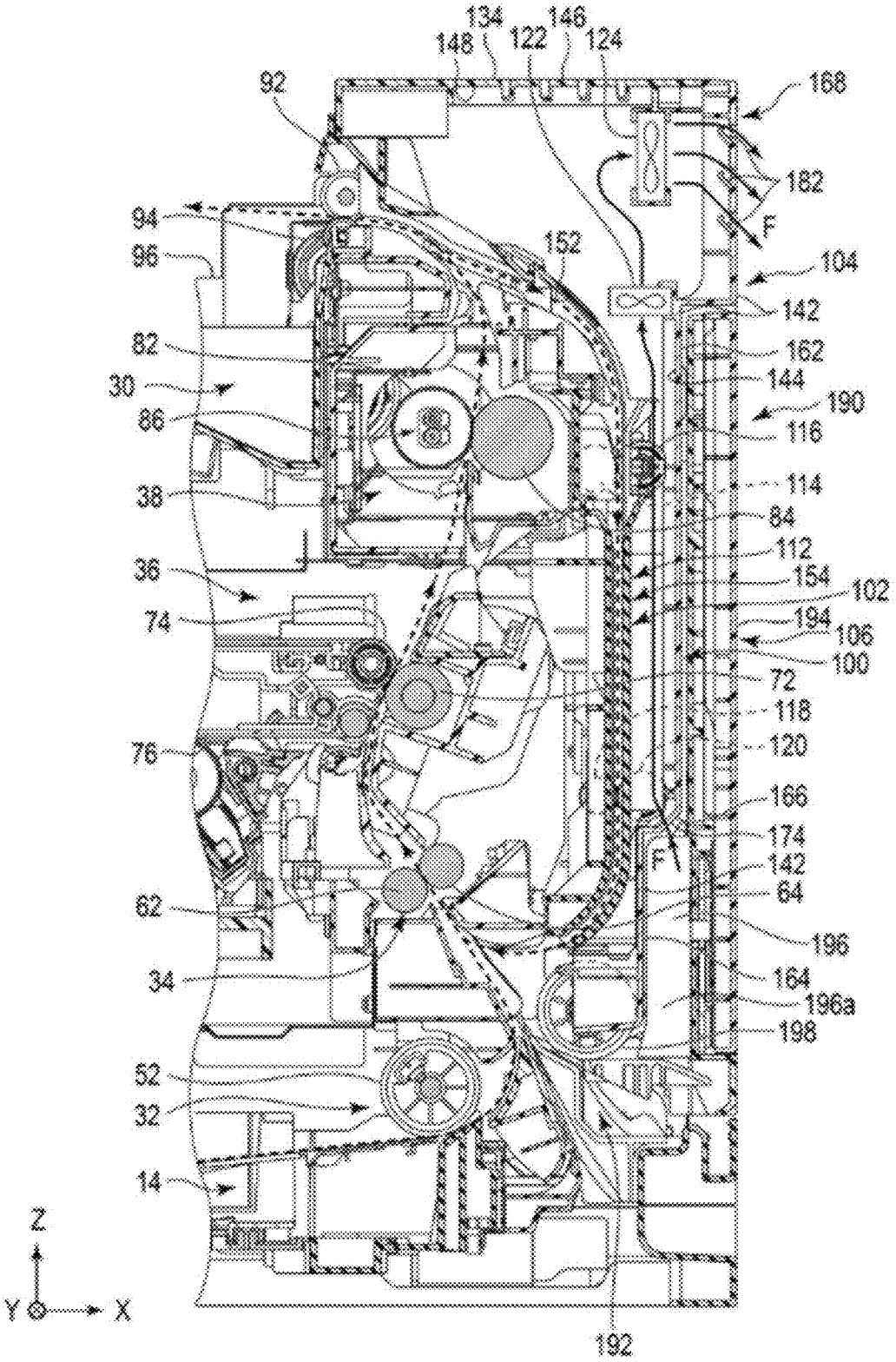
FIG. 5 is a schematic cross-sectional view taken along a surface V-V in FIG. 2.

The main body 12 has a substantially rectangular parallelepiped skeleton structure. As shown in FIGS. 4 and 5, the main body 12 includes an image forming section 30 therein.

The sheet housing section 14 is provided below the main body 12. The sheet housing section 14 has a tray shape, and accommodates sheets of a preset size and type. The sheet housing section 14 is pulled out to the front side with respect to the main body 12 to accommodate a sheet on which an image is to be formed by the image forming apparatus 10.

The scanner section 16 is provided above the main body 12. The scanner section 16 reads image information of a reading target placed on glass or the like on an upper surface thereof. The image forming apparatus 10 records the image information read by the scanner section 16. The image forming section 30 prints the recorded image information on the sheet. The image forming apparatus 10 may transmit the recorded image information to another information processing apparatus via, for example, a network without printing the recorded image information on the sheet with the image forming section 30.

The display section 18 and the control panel 20 are positioned on the front side of the scanner section 16. The display section 18 is an image display device such as a liquid crystal display, an organic EL (Electro Luminescence) display, or the like. The display section 18 displays various kinds of information relating to the image forming apparatus 10. The control panel 20 includes, for example, a plurality of buttons. The control panel 20 receives an operation by a user. The control panel 20 outputs a signal corresponding to a pressing operation on a button by the user to a control section of the image forming apparatus 10.

The display section 18 and the control panel 20 may be integrated with each other to form a touch panel.

The sheet includes a PPC sheet, a transparent plastic sheet (TP sheet) and a postcard. The image forming apparatus 10 can perform printing not only on a sheet of a fixed size but also on a sheet of a non-fixed size.

As shown in FIGS. 4 and 5, the image forming section 30 includes a sheet feed section 32, a registration section 34, a transfer section 36, a fixing section 38 and a sheet discharge section 40.

The sheet feed section 32 is adjacent to an upper side of the sheet housing section 14. The registration section 34 is provided above the sheet feed section 32. The transfer section 36 is provided above the registration section 34. The fixing section 38 is provided above the transfer section 36. The sheet discharge section 40 is provided above the fixing section 38. The scanner section 16 is provided above the sheet discharge section 40.

The sheet feed section 32 has a sheet feed roller 52. A rotation axis of the sheet feed roller 52 is, for example, parallel to the Y axis. The sheet feed roller 52 rotates to take out sheets accommodated in the sheet housing section 14 one by one.

The registration section 34 has a pair of registration rollers 62 and 64. The rotation axes of the registration rollers 62 and 64 are parallel to the Y axis. The registration rollers 62 and 64 rotate with the sheet sandwiched therebetween at an appropriate timing to convey the sheet to the transfer section 36.

The transfer section 36 includes a secondary transfer roller 72, a secondary transfer opposing roller 74 and a transfer belt 76. Rotation axes of the secondary transfer roller 72 and the secondary transfer opposing roller 74 are parallel to the Y axis. In the transfer section 36, a toner image on the transfer belt 76 is transferred onto the sheet through the electric field generated between the secondary transfer roller 72 and the secondary transfer opposing roller 74.

The fixing section 38 includes a fixing roller 82, a pressure roller 84 and a heater 86. Rotation axes of the fixing roller 82 and the pressure roller 84 are parallel to the Y axis. The transfer section 36 conveys the sheet between the fixing roller 82 and the pressure roller 84. In the fixing section 38, the sheet is heated by the fixing roller 82 heated by the heater 86 and is pressed by the fixing roller 82 and the pressure roller 84, and thus a toner image on a surface (first surface) of the sheet is fixed to the surface of the sheet.

The sheet discharge section 40 includes sheet discharge rollers 92 and 94, and a sheet discharge tray 96. Rotation axes of the sheet discharge rollers 92 and 94 are parallel to the Y axis. The sheet discharge tray 96 is provided on the left side of the sheet discharge rollers 92 and 94 in the present embodiment. The sheet discharge tray 96 is provided below the scanner section 16. The sheet discharge rollers 92 and 94 rotate at an appropriate timing to convey the sheet to the sheet discharge tray 96. In the case of performing duplex printing, the sheet discharge rollers 92 and 94 reversely rotate at an appropriate timing to switch back the sheet.

The main body 12 is provided with a circulation conveyance unit 100 for duplex printing. In the present embodiment, the circulation conveyance unit 100 is provided on the right side of the image forming section 30.

The circulation conveyance unit 100 includes a sheet conveyance section (circulation conveyance section) 102 for duplex printing, a first external cover 104 and a second external cover 106.

The sheet conveyance section 102 includes a conveyance path 112, upper rollers 114 and 116, and lower rollers 118 and 120.

The conveyance path 112 is provided in the main body 12. The conveyance path 112 is provided in the image forming section 30 and the first external cover 104. The conveyance path 112 is used for conveying the sheet switched back by the sheet discharge section 40 toward the registration section 34 of the image forming section 30 between the image forming section 30 and the first external cover 104.

The conveyance path 112 is provided on the right side of the sheet discharge rollers 92 and 94. A width of the conveyance path 112 extends along the Y-axis direction. The width of the conveyance path 112 is, for example, larger than that of a sheet of A4 standard (210 mm*297 mm). In the conveyance path 112, one or more pairs of upper rollers 114 and 116 and one or more pairs of lower rollers 118 and 120 are provided.

The upper rollers 114 and 116 are adjacent to each other in the X-axis direction in a mutually contact manner. The upper roller 114 is closer to the fixing section 38 with respect to the upper roller 116. The upper roller 114 is provided on the image forming section 30 side of the conveyance path 112. The upper roller 116 is provided on the first external cover 104 side of the conveyance path 112.

The lower rollers 118 and 120 are adjacent to each other in the X-axis direction in a mutually contact manner. The lower roller 118 is closer to the transfer section 36 and the registration section 34 with respect to the lower roller 120. The lower roller 118 is provided on the image forming section 30 side of the conveyance path 112. The lower roller 120 is provided on the first external cover 104 side of the conveyance path 112.

The rotation axes of the upper rollers 114 and 116 and the lower rollers 118 and 120 are parallel to the Y axis. A width along the Y-axis direction of each of the upper rollers 114 and 116 and lower rollers 118 and 120 is less than a width of the conveyance path 112 along the Y-axis direction. Therefore, there is a space at a position adjacent to each of the upper rollers 114 and 116 and lower rollers 118 and 120 in the Y-axis direction. One or more pairs of the upper rollers 114 and 116 may be provided along the Y-axis direction. One or more pairs of the lower rollers 118 and 120 may be provided along the Y-axis direction.

The upper roller 114 is rotated by motor drive, for example. The upper roller 116 is driven to rotate by the motor drive of the upper roller 114. The lower roller 118 is rotated by motor drive, for example. The lower roller 120 is driven to rotate by the motor drive of the lower roller 118.

The first external cover 104 is a right cover of the image forming apparatus 10 and protects the sheet conveyance section 102.

A first fan 122 is provided between the conveyance path 112 of the sheet conveyance section 102 and the first external cover 104. The first fan 122 is, for example, an axial fan having a rotation axis parallel to the Z axis. The first fan 122 is, for example, provided in the first external cover 104. The first fan 122 may be provided in the image forming section 30 instead of the first external cover 104. The first fan 122 is rotated to generate an air flowing from the lower side to the upper side thereof between the conveyance path 112 of the sheet conveyance section 102 and the first external cover 104 as shown by a solid line indicated by a reference symbol F in FIGS. 4 and 5. A direction of the flow of the air by the drive of the first fan 122 is, for example, parallel to the Z-axis direction.

A second fan 124 is provided between the conveyance path 112 of the sheet conveyance section 102 and the first external cover 104. The second fan 124 is provided above the first fan 122. The second fan 124 is, for example, an axial fan having a rotation axis parallel to the X axis. The second fan 124 is, for example, provided in the first external cover 104. The second fan 124 may be provided in the image forming section 30. The second fan 124 is rotated to generate an air flowing from inside to outside of the image forming apparatus 10 between the conveyance path 112 of the sheet conveyance section 102 and the first external cover 104 as shown by a solid line indicated by the reference symbol F in FIGS. 4 and 5. A direction of the flow of the air by the drive of the second fan 124 is, for example, parallel to the X-axis direction.

The first fan 122 is not limited to the axial fan. The first fan 122 may be, for example, a centrifugal fan, a diagonal flow fan, or a cross flow fan. The second fan 124 is not limited to an axial fan. The second fan 124 may be, for example, a centrifugal fan, a mixed flow fan or a cross flow fan. The first fan 122 and the second fan 124 may be of the same type or different types.

The first external cover 104 is provided on the main body 12 and covers the conveyance path 112. The first external cover 104 has a cover main body 132 and an upper cover portion 134. The cover main body 132 is integrated with the upper cover portion 134.

The cover main body 132 has a wall parallel to or substantially parallel to the Y axis. The cover main body 132 has an outer surface portion 142 and an inner surface portion 144.

The outer surface portion 142 substantially faces an outer side of the image forming apparatus 10 in the X-axis direction. In the present embodiment, the outer surface portion 142 faces a right side. The outer surface portion 142 is exposed to the outside of the image forming apparatus 10.

The inner surface portion 144 faces the sheet conveyance section 102 of the image forming apparatus 10. The inner surface portion 144 substantially faces the image forming section 30 on the left side of the cover main body 132. The inner surface portion 144 has a plurality of ribs 172 that reinforces the cover main body 132. The plurality of ribs 172 is oriented to the image forming section 30 and the conveyance path 112, and is used as a spacer for generating a space from the image forming section 30 and the conveyance path 112.

The upper cover portion 134 has a wall parallel to or substantially parallel to the Y axis. The upper cover portion 134 has an outer surface portion 146 and an inner surface portion 148. The outer surface portion 146 substantially faces the scanner section 16 of the image forming apparatus 10. The inner surface portion 148 faces the sheet conveyance section 102 positioned at the lower side thereof. In the present embodiment, the upper cover portion 134 is blocked. The upper cover portion 134 may be opened, for example, in a louver manner.

The conveyance path 112 has a first guide 152 and a second guide 154.

The first guide 152 is provided in the inner surface portion 144 of the cover main body 132. The first guide 152 faces the inner surface portion 144 of the cover main body 132 and the inner surface portion 148 of the upper cover portion 134. The first guide 152 is curved in such a manner that it is directed downward as it goes to the right side along the X-axis direction. Through the reverse rotation of the sheet discharge rollers 92 and 94 of the sheet discharge section 40, the sheet is guided from the sheet discharge rollers 92 and 94 toward the upper rollers 114 and 116 in the cover main body 132.

The first fan 122 is provided above the upper roller 116 between the first guide 152 and the inner surface portion 144 of the cover main body 132. There is a space between the upper side of the first guide 152 and the inner surface portion 148 of the upper cover portion 134.

The second guide 154 is provided in the inner surface portion 144 of the cover main body 132. The second guide 154 is provided below the first guide 152. The second guide 154 has a pair of opposing wall portions. The opposing surfaces of the pair of wall portions maintain an equal distance or a substantially equal distance therebetween. The opposing surfaces of the pair of wall portions of the second guide 154 each include a flat surface and a curved surface. An upper side thereof is a flat surface, and a lower side thereof is a curved surface. The flat surface of the second guide 154 extends in the Z-axis direction (vertical direction). The flat surface of the second guide 154 guides the sheet guided by the first guide 152 from the upper side to the lower side of the cover main body 132. The curved surface of the second guide 154 guides the sheet from the inner surface portion 144 of the cover main body 132 toward the registration section 34. The curved surface of the second guide 154 is directed to the left side on which the registration section 34 of the image forming section 30 is positioned as it goes downward along the Z-axis direction.

The pair of opposing wall portions of the second guide 154 in FIGS. 4 and 5 is blocking surfaces that block the flow of air in the X-axis direction. The pair of opposing wall portions of the second guide 154 may be grid-like surfaces that allow the flow of air in the X-axis direction.

The second fan 124 is provided between the first guide 152 and the inner surface portion 144 of the cover main body 132, and also between the first guide 152 and the inner surface portion 148 of the upper cover portion 134. The second fan 124 may be provided between the first guide 152 and the inner surface portion 148 of the upper cover portion 134.

The upper rollers 114 and 116 are provided at or near a boundary between the first guide 152 and the second guide 154. The first guide 152 and the second guide 154 guide the sheet sandwiched between the upper rollers 114 and 116 downward in the Z-axis direction through the rotation of the upper roller 114.

The lower rollers 118 and 120 are provided at or near a boundary between the flat surface and the curved surface of the second guide 154. The second guide 154 guides the sheet sandwiched between the lower rollers 118 and 120 to the registration rollers 62 and 64 of the registration section 34 through the rotation of the lower roller 118.

For example, a central axis parallel to the Y-axis direction of the upper roller 114 is provided above a central axis parallel to the Y-axis direction of the lower roller 118 in the Z-axis direction. A central axis parallel to the Y-axis direction of the lower roller 120 is provided above a central axis parallel to the Y-axis direction of the upper roller 116 in the Z-axis direction.

As shown in FIG. 3, the cover main body 132 has an arrangement portion 160 for arranging the second external cover 106. The arrangement portion 160 is, for example, concave.

The cover main body 132 includes a blocking wall 162, a concave portion (sheet guide arrangement portion) 164, a communication portion 166 and an air exhaust portion 168. The blocking wall 162, the concave portion 164 and the communication portion 166 are provided at the arrangement portion 160. The blocking wall 162 and the concave portion 164 each have a surface parallel to the Y-Z plane.

The lengths of the blocking wall 162 and the concave portion 164 in the Y-axis direction are, for example, about 350 mm. The length of the blocking wall 162 in the Z-axis direction is, for example, about 250 mm. The length of the concave portion 164 in the Z-axis direction is, for example, about 100 mm. The blocking wall 162 has the largest area in the outer surface portion 142 of the arrangement portion 160 in the cover main body 132. The blocking wall 162 faces the conveyance path 112, the upper roller 116 and the lower roller 120 of the sheet conveyance section 102. The lower roller 120 is provided in the vicinity of the lower end of the blocking wall 162. The inner surface portion 144 of the blocking wall 162 faces both the first guide 152 and the second guide 154.

The concave portion 164 is provided below the blocking wall 162. The concave portion 164 is recessed toward the main body 12 and connecting the lower end of the blocking wall 162. The inner surface portion 144 of the concave portion 164 faces the second guide 154.

As shown in FIGS. 4 to 6A, the communication portion 166 penetrates the outer surface portion 142 and the inner surface portion 144 of the first external cover 104. The communication portion 166 is provided between a lower end of the blocking wall 162 and an upper end of the concave portion 164. The communication portion 166 is provided at a position lower than positions of ears of a person standing or sitting in a state in which the image forming apparatus 10 is placed on a floor. In the example shown in FIG. 6A, the lower end of the blocking wall 162 is provided above the upper end of the concave portion 164. In the example shown in FIG. 6B, the lower end of the blocking wall 162 and the upper end of the concave portion 164 are provided at the same position in the horizontal direction. Furthermore, the lower end of the blocking wall 162 may be provided below the upper end of the concave portion 164.

Figure 6A:
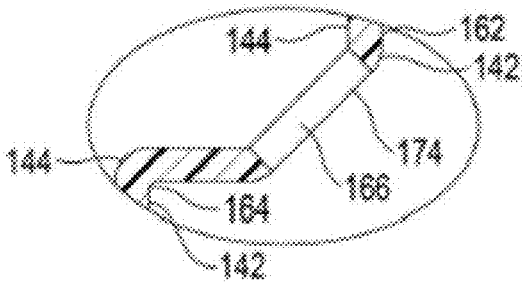
FIG. 6A is an enlarged view of a position indicated by a reference symbol VI of a first external cover in FIG. 4.
Figure 6B:
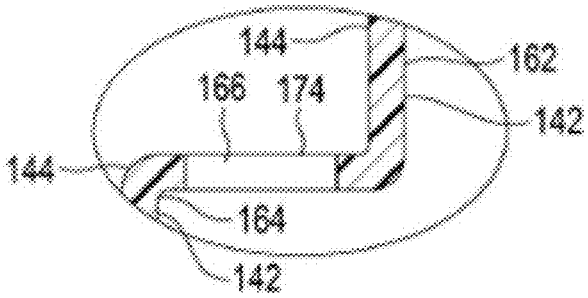
FIG. 6B is a diagram illustrating a modification of an example shown in FIG. 6A.

As shown in FIGS. 6A-B, the communication portion 166 can include a plurality of ribs 174 connecting the lower end of the blocking wall 162 with the upper end of the concave portion 164. In the example shown in FIG. 6A, the rib 174 extends along the Z-X plane. In the example shown in FIG. 6B, the rib 174 extends along the X-axis direction. The plurality of ribs 174 connects a part of the lower end of the blocking wall 162 with a part of the upper end of the concave portion 164. Thus, at the time vibration is transmitted to, for example, the blocking wall 162 and the concave portion 164, the plurality of ribs 174 enables the blocking wall 162 and the concave portion 164 to move together. The vibration transmitted to the blocking wall 162 and the concave portion 164 is suppressed due to a phase shift of the vibration. The communication portion 166 is provided below the blocking wall 162 and faces an outer space of the image forming apparatus 10 at a position facing the concave portion 164. The communication portion 166 may be directed to the floor (in practice, the second external cover 106) at the outside of the image forming apparatus 10 as shown in FIG. 6A, and may be directed to a lower portion of the image forming apparatus 10 as shown in FIG. 6B. The communication portion 166 may be directed to the outer surface portion 142 of the concave portion 164.

The air exhaust portion 168 is provided above the blocking wall 162 of the arrangement portion 160. The air exhaust portion 168 penetrates the outer surface portion 142 and the inner surface portion 144 of the first external cover 104 and has an air exhaust port 182 exhausting the air to the outside of the image forming apparatus 10. The air exhaust port 182 is, for example, a louver. The air exhaust port 182 guides the flow of air from the inside to the outside of the image forming apparatus 10 downward. The air exhaust port 182 may be a grid or an opening.

The second external cover 106 is provided at the further outside of the first external cover 104. The second external cover 106 is a manual sheet feed tray 190 in the present embodiment.

A support portion 192 is provided between the first external cover 104 and the second external cover 106. The support portion 192 supports the lower end portion of the first external cover 104 and the lower end portion of the second external cover 106 at the lower end portion of the main body 12. The support portion 192 supports the lower end portion of the second external cover 106 (i.e., sheet feed tray 190). The support portion 192 supports the sheet feed tray 190 in such a manner that the sheet feed tray 190 can rotate around a rotation axis thereof along the Y-axis direction. The sheet feed tray 190 can move between a first position in an upright position shown in FIG. 2 and a second position inclined with respect to the first position shown in FIG. 1 through the support portion 192. An appropriate gap is formed between the lower end of the sheet feed tray 190 and the outer surface portion 142 of the cover main body 132 of the first external cover 104.

The sheet feed tray 190 has a tray main body 194 and a sheet guide 196. The sheet guide 196 has a pair of side walls **196*a*. The pair of side walls 196*a* is opposed to each other. The pair of side walls 196*a* can approach to or separate from each other along the Y-axis direction in accordance with the width of the sheet. For this reason, the sheet guide 196 can adjust a distance between the pair of side walls 196*a*. Below the second guide 154, a conveyance roller 198 for conveying the sheet placed on the tray main body 194 of the sheet feed tray 190 toward the registration rollers 62 and 64 of the registration section 34** is provided.

If the sheet feed tray 190 is positioned at the first position, the sheet guide 196 of the second external cover 106 faces the outer surface portion 142 of the concave portion 164 of the first external cover 104. The distance between the outer surface portion 142 of the concave portion 164 and the tray main body 194 is larger than that between the outer surface portion 142 of the blocking wall 162 and the tray main body 194. Therefore, a space present between the outer surface portion 142 of the concave portion 164 and the tray main body 194 is larger than a gap between the outer surface portion 142 of the blocking wall 162 and the tray main body 194. The flow of air is not blocked between the communication portion 166 and the space between the outer surface portion 142 of the concave portion 164 and the tray main body 194. Therefore, at the time the sheet feed tray 190 is positioned at the first position, the second external cover 106 secures a space at the outside of the first external cover 104.

A volume of the space between the outer surface portion 142 of the concave portion 164 and the tray main body 194 is equal to or larger than that defined by a length L along the longitudinal direction of the side wall **196*a* of the sheet guide 196, a height H of the pair of side walls 196*a* of the sheet guide 196 and a width of the tray main body 194** in the Y-axis direction.

The first external cover 104 is provided with an unlocking portion 200 against the main body 12, for example, in the vicinity of the upper end portion of the air exhaust portion 168 of the cover main body 132. The first external cover 104 and the second external cover 106 rotate around the support portion 192 through unlocking by the unlocking portion 200 from the main body 12. Therefore, the upper roller 116, the lower roller 118, the first fan 122, the second fan 124, the first guide 152 and the second guide 154 rotate around the support portion 192 with respect to the image forming section 30 in addition to the first external cover 104 and the second external cover 106. Therefore, the sheet can be taken out in a case in which a sheet jam occurs in the circulation conveyance unit 100 during the duplex printing in the image forming apparatus 10.

At the time the image forming apparatus 10 performs printing on the sheet, the sheet is moved along a dotted arrow shown in FIGS. 4 and 5. In the image forming apparatus 10, the sheet feed roller 52 of the sheet feed section 32 is rotated, and in this way, the sheets accommodated in the sheet housing section 14 are taken out one by one by the sheet feed section 32 and then conveyed to the registration section 34. The registration section 34 performs an inclination correction on the sheet, and the registration rollers 62 and 64 are rotated to convey the sheet to the transfer section 36 in the image forming apparatus 10. While the sheet is conveyed to the fixing section 38, a toner image is transferred onto the sheet by the transfer belt 76 of the transfer section 36 in the image forming apparatus 10. The transfer belt 76 transfers the toner image onto the one surface of the sheet (first surface). In the image forming apparatus 10, the fixing section 38 fixes the toner image on the one surface of the sheet to the sheet through heat and pressure, and then the sheet is conveyed to the sheet discharge section 40. In the case of simplex printing, the sheet discharge rollers 92 and 94 are rotated in a predetermined direction to discharge the sheet to the sheet discharge tray 96 in the image forming apparatus 10.

If the duplex printing is performed on the sheet, in the image forming apparatus 10, the sheet discharge rollers 92 and 94 of the sheet discharge section 40 is reversely rotated, and in this way, the sheet of which one surface is printed is switched back without being discharged to the sheet discharge tray 96. In the image forming apparatus 10, the sheet is conveyed from the sheet discharge section 40 to the first guide 152 on the conveyance path 112 of the sheet conveyance section 102. In the image forming apparatus 10, the sheet conveyed to the first guide 152 is then conveyed to the second guide 154 through the rotation of the upper roller 114 in a state of being sandwiched between the upper roller 114 and the upper roller 116. In the image forming apparatus 10, the sheet conveyed to the second guide 154 is then conveyed to the registration section 34 through the second guide 154 through the rotation of the lower roller 118 in a state of being sandwiched between the lower roller 118 and the lower roller 120.

In the image forming apparatus 10, the registration rollers 62 and 64 of the registration section 34 are rotated to convey the sheet to the transfer section 36. A surface of the sheet facing the transfer belt 76 of the transfer section 36 is a second surface opposite to the surface (first surface) of the sheet before passing through the sheet conveyance section 102. In the image forming apparatus 10, while the sheet is conveyed to the fixing section 38, the toner image is transferred onto the sheet by the transfer belt 76 of the transfer section 36. Therefore, the transfer section 36 transfers the toner image onto an opposite surface (second surface) opposite to the one surface (first surface) of the sheet. In the image forming apparatus 10, the fixing section 38 fixes the toner image on the second surface on the sheet through heat and pressure, and then conveys the sheet to the sheet discharge section 40. The sheet is discharged to the sheet discharge tray 96 in the image forming apparatus 10.

In a case in which the simplex printing is performed on the sheet placed on the tray main body 194 of the sheet feed tray 190 positioned at the second position shown in FIGS. 1 and 4, in the image forming apparatus 10, the conveyance roller 198 is rotated to convey the sheet to the registration section 34. As described above, in the image forming apparatus 10, the first surface of the sheet is printed through the transfer section 36 and the fixing section 38 and then the sheet is discharged to the sheet discharge tray 96 of the sheet discharge section 40.

In a case in which the duplex printing is performed on the sheet placed on the tray main body 194 of the sheet feed tray 190, in the image forming apparatus 10, the conveyance roller 198 is rotated to convey the sheet to the registration section 34. As described above, in the image forming apparatus 10, the first surface of the sheet is printed through the transfer section 36 and the fixing section 38 and then the sheet is switched back by the sheet discharge section 40. In the image forming apparatus 10, the sheet conveyed to the registration section 34 through the sheet conveyance section 102 is printed on the second surface thereof through the transfer section 36 and the fixing section 38, and then is discharged to the sheet discharge tray 96 of the sheet discharge section 40.

In the case of the duplex printing, as shown in the dotted line in FIGS. 4 and 5, the sheet heated through the heat of the heater 86 of the fixing section 38 passes through the conveyance path 112 of the sheet conveyance section 102 and then is conveyed from the registration section 34 to the sheet discharge section 40 again, for example. Therefore, at the time the sheet of which the first surface is printed passes through the conveyance path 112, a part of the heat of the sheet is transferred to the conveyance path 112, and thus a temperature of the conveyance path 112 rises.

In the case of the duplex printing, in the image forming apparatus 10, the first fan 122 and the second fan 124 are continuously operated until the printing on the first surface and the second side opposite to the first surface of the sheet is finished, for example. The air in a space facing the outer surface portion 142 of the concave portion 164 of the first external cover 104 of the image forming apparatus 10 flows toward the first fan 122 through the communication portion 166 through the operation of the first fan 122.

There is a space between the inner surface portion 144 of the blocking wall 162 of the first external cover 104 and the conveyance path 112 of the sheet conveyance section 102. The communication portion 166 is provided at the lower end of the blocking wall 162. The air that enters the image forming apparatus 10 from the communication portion 166 is directed upwards through the space between the inner surface portion 144 of the blocking wall 162 and the conveyance path 112. The blocking wall 162 is not provided with an opening for exhausting the air. Therefore, in the image forming apparatus 10, the air flowing between the communication portion 116 and the first fan 122 is prevented from being influenced by the outside between the communication portion 116 and the first fan 122. Thus, the air flows straight or substantially straight between the communication portion 166 and the first fan 122.

The air flowing from the communication portion 166 toward the upper side of the image forming apparatus 10 takes heat away from the conveyance path 112 as it flows to the upper side. For this reason, the conveyance path 112 is air-cooled by the air flowing from the communication portion 166 toward the upper side of the image forming apparatus 10. The air flows along the blocking wall 162 by a length of the blocking wall 162 along the Z-axis direction. Since a width of the communication portion 166 is substantially the same as that of the conveyance path 112, a portion of the conveyance path 112 facing the inner surface portion 144 of the blocking wall 162 is air-cooled by the air.

In the case of the duplex printing in the image forming apparatus 10 according to the present embodiment, in the image forming apparatus 10, after the first surface of the sheet is printed by the image forming section 30, the sheet with heat takes heat away from the conveyance path 112 while passing through the conveyance path 112. Therefore, in the image forming apparatus 10, at the time of performing the printing on the second surface of the same sheet by the image forming section 30, a temperature between the registration section 34 and the sheet discharge section 40 is prevented from rising.

If a pair of opposing wall portions of the second guide 154 allows the air flowing in the X-axis direction, at the time the sheet with heat passes through the conveyance path 112, the air flowing from the communication portion 166 toward the upper side of the image forming apparatus 10 takes heat away from the conveyance path 112 and the sheet.

The air moving toward the upper side of the first fan 122 through the space between the inner surface portion 144 of the blocking wall 162 and the conveyance path 112 is directed to a space between the first guide 152 and the inner surface portion 148 of the upper cover portion 134 through the operation of the first fan 122. The temperature of the air in the space between the first guide 152 and the inner surface portion 148 of the upper cover portion 134 may be higher than that of the air in the communication portion 166.

In the image forming apparatus 10, the second fan 124 is operated as the first fan 122 operates. The second fan 124 directs the air in the space between the first guide 152 and the inner surface portion 148 of the upper cover portion 134 to the air exhaust port 182 of the air exhaust portion 168. In the image forming apparatus 10, the air in the space between the first guide 152 and the inner surface portion 148 of the upper cover portion 134 is exhausted from the air exhaust port 182 of the air exhaust portion 168 to the outside of the image forming apparatus 10.

In the image forming apparatus 10, the air flowing between the communication portion 116 and the second fan 124 is prevented from being influenced by the outside between the communication portion 116 and the second fan 124. Thus, the air flows between the communication portion 166 and the second fan 124 at an appropriate speed.

As described above, in the case of the duplex printing, in the image forming apparatus 10, the first fan 122 and the second fan 124 continuously operate until the printing on the first surface and the second surface opposite to the first surface of the sheet is finished, for example. Therefore, the air flows not only when the sheet is conveyed to the conveyance path 112 but also before and after the sheet is conveyed. Thus, in the image forming apparatus 10, while the first fan 122 and the second fan 124 continuously operate, the air flowing from the communication portion 166 to the upper side of the image forming apparatus 10 takes heat away from the conveyance path 112.

In a case in which the sheet feed tray 190 of the second external cover 106 is positioned at the second position shown in FIGS. 1 and 4, the space extends to a position facing the outer surface portion 142 of the concave portion 164 below the communication portion 166. Therefore, the image forming apparatus 10 exhausts the air to the outside of the image forming apparatus 10 while taking in the air having a temperature lower than that in the image forming apparatus 10 from the communication portion 166 to the inside of the image forming apparatus 10.

In a case in which the sheet feed tray 190 of the second external cover 106 is positioned at the first position shown in FIGS. 2 and 5, the space in which the sheet guide 196 is provided extends to a position facing the outer surface portion 142 of the concave portion 164 below the communication portion 166. There is no obstruction between the communication portion 166 and the above space. The minimum volume of the space is defined by a length L and a height H of the sheet guide 196 and the width of the tray main body 194. There is a gap between the concave portion 164 of the cover main body 132 of the first external cover 104 and a lower end of the tray main body 194 of the second external cover 106. Therefore, the image forming apparatus 10 takes in the air to the space, for example, through the gap between concave portion 164 of the cover main body 132 of the first external cover 104 and the lower end of the tray main body 194 of the second external cover 106. The communication portion 166 is provided as an air sucking port toward the space extending over the entire surface of the outer surface portion 142 of the concave portion 164, and thus cooling air can be sucked from the air even if the sheet feed tray 190 is provided in the arrangement portion 160. The image forming apparatus 10 cools the sheet conveyance section 102 and exhausts the air to the outside of the image forming apparatus 10 while taking in the air in the space at a temperature lower than that in the image forming apparatus 10 to the inside of the image forming apparatus 10 through the communication portion 166.

The image forming apparatus 10 according to the present embodiment can stably cool the sheet conveyance section 102 regardless of the position of the sheet feed tray 190 of the second external cover 106. The present embodiment can provide the image forming apparatus 10 that efficiently cools the sheet conveyance section for the duplex printing.

For example, at the time the printing is performed on the sheet by the image forming section 30, the sheet feed section 32, the registration section 34, the transfer section 36, the fixing section 38 and the sheet discharge section 40 of the image forming section 30 operate, and thus a sound is generated. The sound propagates in all directions from sound sources. In the present embodiment, the first external cover 104 is provided in the horizontal direction such as the X-axis direction of the image forming section 30. The cover main body 132 of the first external cover 104 has the blocking wall 162 and the communication portion 166. Since the blocking wall 162 has no opening, a part of the sound from the sound sources is absorbed by the blocking wall 162, and a part thereof is reflected toward the image forming section 30. The communication portion 166 is opened toward the lower side of the image forming apparatus 10. The sound is emitted from the inside of the image forming apparatus 10 to the lower side of the image forming apparatus 10 through the communication portion 166. The communication portion 166 is generally provided at a position lower than positions of ears of a person standing or sitting. The communication portion 166 provided at a lower position than the blocking wall 162 suppresses the influence of the sound on the outside of the image forming apparatus 10 when the sound is emitted from the communication portion 166. In a case in which the sheet feed tray 190 is positioned at the first position, the image forming apparatus 10 prevents the sound from being emitted to the outside of the image forming apparatus 10 through the sheet feed tray 190 as compared to a case in which the sheet feed tray 190 is positioned at the second position.

In the present embodiment, for example, even if the sheet feed tray 190 is positioned at the second position, the image forming apparatus 10 can suppress the influence on the outside of the image forming apparatus 10 by the sound emitted from the image forming section 30 at the time of performing the printing, for example.

The air exhaust port 182 of the air exhaust portion 168 directs the direction of flow of the air to the floor. For this reason, the sound is directed to the floor. Therefore, the image forming apparatus 10 according to the present embodiment suppresses the influence of the sound on the outside of the image forming apparatus 10 also through the air exhaust port 182 of the air exhaust portion 168.

The communication portion 166 has a plurality of ribs 174 connecting the lower end of the blocking wall 162 with the upper end of the concave portion 164. If the sheet feed section 32, the registration section 34, the transfer section 36, the fixing section 38 and the sheet discharge section 40 of the image forming section 30 operate, vibration occurs. The vibration is transmitted to the first external cover 104 through various paths. The rib 172 provided in the inner surface portion 144 of the cover main body 132 of the first external cover 104 enhances the rigidity of the first external cover 104 as compared to the case in which no rib 172 is provided. Therefore, the vibration of the first external cover 104 is suppressed by the rib 172 provided in the inner surface portion 144 of the cover main body 132.

The plurality of ribs 174 between the blocking wall 162 and the concave portion 164 enhances the rigidity of the first external cover 104 as compared to the case in which the plurality of ribs 174 is not provided. Therefore, the plurality of ribs 174 in the communication portion 166 suppresses the vibration of the first external cover 104.

According to the present embodiment, the image forming apparatus 10 can reliably cool the conveyance path 112. According to the present embodiment, the image forming apparatus 10 can suppress the influence of the sound from the inside of the main body 12.

In the image forming apparatus 10 according to the first embodiment, the first fan 122 and the second fan 124 are used. The image forming apparatus 10 does not necessarily have the second fan 124. The air exhaust port 182 of the air exhaust portion 168 exhausts the air in the space between the first guide 152 and the inner surface portion 148 of the upper cover portion 134 to the outside of the image forming apparatus 10. In this case, the air exhaust port 182 of the air exhaust portion 168 may be provided in the upper cover portion 134.

In the image forming apparatus 10 according to the first embodiment, the first fan 122 and the second fan 124 are used. If the air in the image forming apparatus 10 has a higher temperature than the air at the outside of the image forming apparatus 10, the communication portion 166 takes in outside air to the image forming apparatus 10 through natural convection. The air in the image forming apparatus 10 is warmed up, and the temperature thereof rises. Therefore, the image forming apparatus 10 does not necessarily have the first fan 122 and the second fan 124. In the case of the duplex printing, at the time the sheet passes through the conveyance path 112, the temperature of the air in the conveyance path 112 and the vicinity thereof rises. The air flows from the communication portion 166 to the conveyance path 112, and the temperature thereof rises. Therefore, the air taken in the image forming apparatus 10 from the communication portion 166 moves upward along the conveyance path 112 and the sheet.

If the first fan 122 and the second fan 124 are not used in the image forming apparatus 10, the image forming apparatus 10 can suppress the generation of sound as compared to a case in which the first fan 122 and the second 124 are used.

Second Embodiment

The second embodiment of the image forming apparatus 10 is described with reference to FIG. 7. The second embodiment is a modification of the first embodiment. The image forming apparatus 10 of the second embodiment is different from that of the first embodiment in the structure of the circulation conveyance unit 100 of the image forming apparatus 10.

Figure 7:
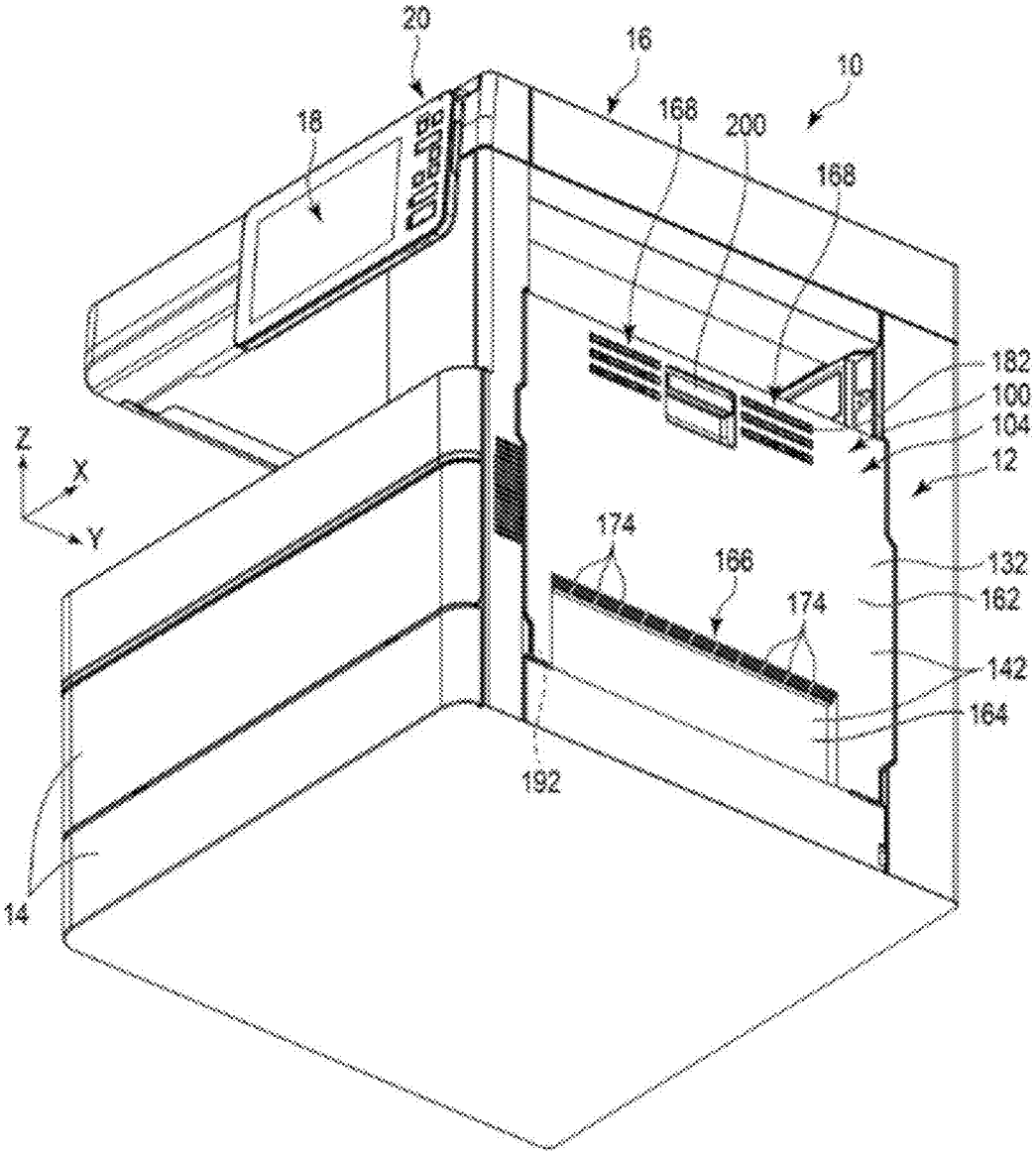
FIG. 7 is a perspective view schematically illustrating an image forming apparatus as viewed obliquely from below according to a second embodiment.

The circulation conveyance unit 100 shown in FIG. 7 includes the sheet conveyance section 102 and the first external cover 104. The structure of the sheet conveyance section 102 is the same as that of the sheet conveyance section 102 described in the first embodiment. There is no the second external cover 106. The cover main body 132 of the first external cover 104 is not provided with the arrangement portion 160 for arranging the second external cover 106. The blocking wall 162 and the outer surface portion 142 of the air exhaust portion 168 each are a flat surface.

In the case of the duplex printing, the temperature of the air in the vicinity of the conveyance path 112 of the sheet conveyance section 102 of the image forming apparatus 10 is higher than that of the air at the outside of the image forming apparatus 10. In this case, the image forming apparatus 10 takes in the air in the space facing the outer surface portion 142 of the concave portion 164 of the cover main body 132 of the first external cover 104 to the image forming apparatus 10 from the communication portion 166 below the conveyance path 112 regardless of the operation of the first fan 122.

According to the present embodiment, the image forming apparatus 10 can reliably cool the conveyance path 112.

In the image forming apparatus 10 according to the present embodiment, the influence of the sound on the outside of the image forming apparatus 10 in a case in which there is an opening in the blocking wall 162 can be suppressed by the first external cover 104.

According to the present embodiment, the image forming apparatus 10 can suppress the influence of the sound from the inside of the main body 12.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a main body;

a conveyance path provided in the main body and configured to extend in a first direction;

a first external cover configured to cover the conveyance path; and a second external cover, provided outside the first external cover, that is configured to secure a space, wherein the first external cover includes a blocking wall facing the conveyance path;

an air exhaust portion, provided above the blocking wall, that penetrates the first external cover; a concave portion provided below the blocking wall and recessed toward the main body with respect to a lower end of the blocking wall; and a communication portion, provided between the lower end of the blocking wall and an upper end of the concave portion, that penetrates a portion of the first external cover and is positioned below the blocking wall and facing downward such that air from the concave portion flows upward through the communication portion toward the air exhaust portion.

2. The image forming apparatus according to claim 1, wherein the communication portion includes a plurality of ribs connecting the lower end of the blocking wall with the upper end of the concave portion.

3. The image forming apparatus according to claim 1, further comprising:

a first fan configured to circulate air between the conveyance path and the blocking wall through the communication portion.

4. The image forming apparatus according to claim 3, further comprising:

a roller adjacent to the conveyance path and having a rotation axis in a second direction orthogonal to the first direction, wherein the first fan is provided above the roller.

5. The image forming apparatus according to claim 3, further comprising:

a second fan, provided above the first fan, configured to circulate air toward the air exhaust portion.

6. The image forming apparatus according to claim 3, further comprising:

a roller adjacent to the conveyance path, provided between the blocking wall and the conveyance path with respect to the conveyance path, that is configured to have a rotation axis in a second direction orthogonal to the first direction, wherein a width of the roller is less than that along a width of the conveyance path along the second direction.

7. The image forming apparatus according to claim 1, wherein the air exhaust portion is provided in the first external cover.

8. The image forming apparatus according to claim 1, wherein the second external cover includes a sheet feed tray and a support portion supporting a lower end portion of the sheet feed tray, the sheet feed tray is movable by the support portion between a first position which is a standing position and a second position inclined with respect to the first position, the sheet feed tray includes a tray main body, and a sheet guide provided in the tray body and in which a distance between side walls thereof can be adjusted, and the sheet guide is provided in the space at a time when the sheet feed tray is positioned at the first position.

9. The image forming apparatus according to claim 8, wherein the first external cover has an arrangement portion for arranging the sheet feed tray at the time when the sheet feed tray is positioned at the first position.

10. An image forming apparatus, comprising:

a main body;

a conveyance path provided in the main body and configured to extend in a first direction; and an external cover provided in the main body and having an inner surface portion facing the conveyance path and an outer surface portion opposite to the inner surface portion, wherein the external cover includes a blocking wall of which the inner surface portion faces the conveyance path; an air exhaust portion, provided above the blocking wall, that penetrates through the inner surface portion and the outer surface portion; a concave portion, provided below the blocking wall, of which the inner surface portion and the outer surface portion are recessed toward the main body with respect to a lower end of the blocking wall; and a communication portion, provided between the lower end of the blocking wall and an upper end of the concave portion, that penetrates through the inner surface portion and the outer surface portion and faces downward such that air from the concave portion flows upward through the communication portion toward the air exhaust portion.

* * * * *